US006481216B2

(12) United States Patent
Simmons et al.

(10) Patent No.: US 6,481,216 B2
(45) Date of Patent: Nov. 19, 2002

(54) MODULAR EUTECTIC-BASED REFRIGERATION SYSTEM

(75) Inventors: Darren W. Simmons, Peachtree City, GA (US); Arthur G. Rudick, Atlanta, GA (US)

(73) Assignee: The Coca Cola Company, Atlanta, GA (US)

( * ) Notice: Subject to any disclaimer, the term of this patent is extended or adjusted under 35 U.S.C. 154(b) by 0 days.

(21) Appl. No.: 09/918,319

(22) Filed: Jul. 30, 2001

(65) Prior Publication Data

US 2002/0007637 A1 Jan. 24, 2002

Related U.S. Application Data

(63) Continuation-in-part of application No. 09/401,164, filed on Sep. 22, 1999, now Pat. No. 6,272,867.

(51) Int. Cl.[7] ..... F25B 9/00; F25D 11/00

(52) U.S. Cl. ..... 62/6; 62/436; 62/393; 62/298

(58) Field of Search ..... 62/6, 258, 430, 62/434, 435, 436, 326, 393

(56) References Cited

U.S. PATENT DOCUMENTS

| | | | | | |
|---|---|---|---|---|---|
| 3,850,006 | A | * | 11/1974 | Redfern et al. | 62/216 |
| 3,888,303 | A | * | 6/1975 | Skala | 165/2 |
| 4,498,297 | A | * | 2/1985 | Darche et al. | 60/525 |
| 4,852,362 | A | * | 8/1989 | Conry | 62/175 |
| 5,524,453 | A | * | 6/1996 | James | 62/434 |
| 5,584,187 | A | * | 12/1996 | Whaley | 62/237 |
| 5,743,108 | A | * | 4/1998 | Cleland | 62/393 |
| 5,778,683 | A | * | 7/1998 | Drees | 62/59 |
| 6,109,337 | A | * | 8/2000 | Gomez | 165/10 |

* cited by examiner

*Primary Examiner*—William C. Doerrler
(74) *Attorney, Agent, or Firm*—Sutherland Asbill & Brennan LLP

(57) ABSTRACT

A refrigeration system for chilling an enclosure. The system may include a thermal transfer pathway with a cold producing unit and a thermal storage unit connected to the pathway via a number of quick disconnect fittings.

45 Claims, 8 Drawing Sheets

| | | Eutectic toon warm | Eutectic at set point [3] | Eutectic too cold |
|---|---|---|---|---|
| Cabinet too warm | Stirling: | Stirling operating at maximum refrigeration capacity | Sitrling modulating to maintain eutectic set point | Stirling modulated to very low power or off |
| | Pump: | Pump operating at full speed | Pump operating at full speed | Pump operating at full speed |
| | Bypass: | Refrigerant loop flows through cabinet heat exchanger | Refrigerant loop flows through cabinet heat exchanger | Refrigerant loop flows through cabinet heat exchanger |
| | Cabinet Fan: | Fan runs at full speed | Fan runs at full speed | Fan runs at full speed |
| Cabinet either at setpoint or too cold | Stirling: | Stirling operating at maximum refrigeration capacity | Sitrling modulating to maintain eutectic set point | Stirling modulated to very low power or off |
| | Pump: | Pump operating at full speed [1] | Pump speed modulates with Stirling 1 | Pump modulated to very low speed or off [1] |
| | Bypass: | Refrigerant loop flows through cabinet heat exchanger | Refrigerant loop flows through cabinet heat exchanger | Refrigerant loop flows through cabinet heat exchanger |
| | Cabinet Fan: | Fan runs at medium speed [2] | Fan runs at medium speed [2] | Fan runs at medium speed [2] |

Notes:
1. The pump operates at a percent of max flowrate proportional to the Sitrling's percent of max power
2. The fan runs at medium speed to reduce power sonsumption while maintaining uniform temperature distribution
3. The Eutectic set point is a few degrees below it's freezing point to ensure that it is completely frozen

Fig. 3

MODULAR EUTECTIC-BASED REFRIGERATION SYSTEM

RELATED APPLICATIONS

The present application is a continuation-in-part of application Ser. No. 09/401,164, filed Sep. 22, 1999, now U.S. Pat. No. 6,272,867 entitled "Apparatus Using Stirling Cooler System and Methods of Use", now allowed.

FIELD OF INVENTION

The present invention relates generally to modular refrigeration systems and, more specifically, to refrigeration systems that use a cold producing unit for removing heat from a desired space and a eutectic-based thermal storage unit to boost the refrigeration capacity during peak loads.

BACKGROUND OF THE INVENTION

Known refrigeration systems generally have used conventional vapor compression Rankine cycle devices as the cold producing unit for a given space. In a typical Rankine cycle apparatus, the refrigerant in the vapor phase is compressed in a compressor so as to cause an increase in temperature. The hot, high-pressure refrigerant is then circulated through a heat exchanger, called a condenser, where it is cooled by heat transfer to the surrounding environment. As a result, the refrigerant condenses from a gas back to a liquid. After leaving the condenser, the refrigerant passes through a throttling device where the pressure and the temperature are reduced. The cold refrigerant leaves the throttling device and enters a second heat exchanger, called an evaporator, located in or near the refrigerated space. Heat transfer with the evaporator and the refrigerated space causes the refrigerant to evaporate or to change from a saturated mixture of liquid and vapor into a superheated vapor. The vapor leaving the evaporator is then drawn back into the compressor so as to repeat the refrigeration cycle.

One alternative to the use of a Rankine cycle system is a Stirling cycle cooler. The Stirling cycle cooler is also a well-known heat transfer mechanism. Briefly described, a Stirling cycle cooler compresses and expands a gas (typically helium) to produce cooling. This gas shuttles back and forth through a regenerator bed to develop much greater temperature differentials than may be produced through the normal Rankine compression and expansion process. Specifically, a Stirling cooler may use a displacer to force the gas back and forth through the regenerator bed and a piston to compress and expand the gas. The regenerator bed may be a porous element with significant thermal inertia. During operation, the regenerator bed develops a temperature gradient. One end of the device thus becomes hot and the other end becomes cold. See David Bergeron, *Heat Pump Technology Recommendation for a Terrestrial Battery-Free Solar Refrigerator*, September 1998. Patents relating to Stirling coolers include U.S. Pat. Nos. 5,678,409; 5,647,217; 5,638,684; 5,596,875; and 4,922,722, all incorporated herein by reference.

Stirling cooler units are desirable because they are nonpolluting, efficient, and have very few moving parts. The use of Stirling coolers units has been proposed for conventional refrigerators. See U.S. Pat. No. 5,438,848, incorporated herein by reference. The integration of a free-piston Stirling cooler into a conventional refrigerated cabinet, however, requires different manufacturing, installation, and operational techniques than those used for conventional compressor systems. See D. M. Berchowitz et al., *Test Results for Stirling Cycle Cooler Domestic Refrigerators*, Second International Conference.

To date, the use of Stirling coolers is not known in refrigerators in general and in beverage vending machines, glass door merchandisers ("GDM's"), and dispensers in particular. Therefore, a need exists for adapting Stirling cooler technology to conventional beverage vending machines, GDM's, dispensers, and the like.

Regardless of the nature of the cold producing unit, another issue with modern refrigeration systems as a whole is the ability to provide cooling in an efficient manner even during peak loads. One means to provide additional cooling to the system as a whole during such peak load periods is through the use of a thermal storage unit. Although such thermal storage units in general are known in the art, the efficient use of such systems demands that the cold producing unit and the thermal storage unit be designed and balanced to address the particular use environment intended for refrigeration system.

As a result, a given refrigeration system may need, for example, a large capacity cold producing unit while only occasionally needing a thermal storage unit, i.e., the system may have a large average heat load but low peak demand loads. Likewise, both the cold producing unit and the thermal storage unit may need to be maximized for extended peak demand loads. Any number of different scenarios may apply.

Although a refrigeration system may need to address certain use parameters, changing the refrigeration capacity of a given system is often difficult. The particular components of the system generally may not be expandable or easily modified. Further, the components in the system may well be proprietary to a given manufacturer such that the components may not be interchangeable with those of another manufacturer or even with a refrigeration system of a different capacity. The ability to vary the capacity of a given system is therefore very limited.

What is needed, therefore, is a means by which the refrigeration capacity of a given refrigeration unit may be varied depending upon the intended use. The various components of the refrigeration unit therefore must be interchangeable and expandable. The cost of such elements, however, should be reasonable as compared to known components and units.

SUMMARY OF THE INVENTION

The present invention thus provides a refrigeration system for chilling an enclosure. The system may include a thermal transfer pathway with a cold producing unit and a thermal storage unit connected to the pathway via a number of quick disconnect fittings.

Specific embodiments of the invention may include using shut off devices as the quick disconnect fittings. The cold producing unit may include one or more modular devices. The cold producing unit also may be a Stirling cooler, a Rankine cycle device, or a Transcritical Carbon Dioxide cycle device. The thermal transfer pathway may include a secondary liquid refrigerant loop with a heat transfer liquid therein. The cold producing unit may be connected to the thermal transfer pathway via a heat exchanger. The heat exchanger may be a fluid or a solid heat exchanger. The thermal transfer pathway may include a pump. The thermal storage unit may include one or more modular devices. The thermal storage unit may include a eutectic material, such as a phase change material, therein. The thermal storage unit may include a heat exchanger positioned therein. The thermal storage unit also may include a temperature sensor.

The refrigeration system further may include an enclosure heat exchanger connected to the thermal transfer loop. The heat exchanger may be positioned for chilling the enclosure. A temperature sensor may be positioned about the heat exchanger so as to determine the temperature within the enclosure. The thermal transfer pathway may include a by-pass valve and a by-pass line so as to by-pass the heat exchanger if desired. The by-pass valve may shut the heat exchanger when the temperature within the enclosure is at or below a predetermined temperature and open the heat exchanger when the temperature is above the predetermined temperature. A control system may operate the thermal transfer pathway, the by-pass valve, and the cold producing unit.

The refrigeration system further may include a heat transfer block in communication with the enclosure heat exchanger. The heat transfer block may include a fluid line therein. The thermal storage unit also may include a fluid line and an agitator therein.

A further embodiment of the present invention may provide for a refrigeration system for chilling an enclosure. The system may include a fluid pathway with a heat transfer fluid therein. One or more Stirling coolers and one or more thermal storage units may be connected to the fluid pathway. A heat exchanger may be positioned in communication with the enclosure. The fluid pathway may include a by-pass valve such that the heat transfer fluid may or may not pass through the heat exchanger. The Stirling coolers and the thermal storage units may connect to the fluid pathway via a number of quick disconnect fittings. The thermal storage unit may include a eutectic material, such as a phase change material, therein.

The refrigeration system further may include a temperature sensor positioned within the enclosure such that the by-pass valve allows the heat transfer fluid to flow though the enclosure heat exchanger when the temperature within the enclosure exceeds a predetermined temperature as sensed by the temperature sensor. The system further may include a control system in communication with the by-pass valve and the temperature sensor.

A further embodiment of the present invention may provide for a beverage dispenser. The dispenser may include a heat transfer pathway with a heat transfer fluid therein. One or more modular cold producing units, one or more modular thermal storage units, and a heat exchanger may be connected to the heat transfer pathway. A product pathway may be positioned about the heat exchanger. The modular cold producing units may be Stirling cycle coolers. The modular thermal storage units may include a eutectic material therein. The modular cold producing units and the modular thermal storage units may be connected to the heat transfer pathway via a number of quick disconnect fittings. The heat transfer pathway may include means to modify the number of modular cold producing units connected thereto so as to modify the total cold producing capacity of the beverage dispenser. The heat transfer pathway also may include means to modify the number of modular thermal storage units connected thereto so as to modify the total thermal storage capacity of the beverage dispenser. The beverage dispenser further may include a heat transfer block in communication with the heat exchanger and the product pathway for heat transfer therethrough.

A further embodiment of the present invention may provide for a refrigeration system for chilling an enclosure. The system may include a thermal transfer pathway with a number of modular cold producing units and modular thermal storage units connected thereto. The number of modular cold producing units and the number of modular thermal storage units connected to the thermal transfer pathway may be modified so as to modify the capacity of the refrigeration system as a whole. A heat exchanger also may be connected to the heat transfer pathway so as to chill the enclosure.

A method of the present invention may provide for determining the configuration of a refrigeration system. The method may include the steps of determining an expected average heat load for the refrigeration system, installing one or more modular cold producing units with a capacity sufficient to accommodate the expected average heat load, determining an expected peak demand load for the refrigeration system, and installing one or more modular thermal storage units with a capacity sufficient to accommodate the expected peak demand load. The modular cold producing units may be Stirling cooler units and the modular thermal storage units may include a eutectic material.

The method further may include the steps of operating the refrigeration system, determining an average heat load for the refrigeration system, and modifying the number of the modular cold producing units to accommodate the average heat load. The step of modifying the number of the modular cold producing units may include adding or removing one or more of the units. The method further may include the steps of operating the refrigeration system, determining a peak demand load for the refrigeration system, and modifying the number of the modular thermal storage units to accommodate the peak demand load. The step of modifying the number of the modular thermal storage units may include adding or removing one or more of the units.

The method further may include the steps of revising the expected average heat -load for the refrigeration system and modifying the number of the modular cold producing units to accommodate the expected average heat load. The method further may include the steps of modifying the expected peak demand load for the refrigeration system and modifying the number of the modular thermal storage units to accommodate the expected peak demand load.

These and other objects, features, and advantages of the present invention will become apparent after review of the following detailed description of the disclosed embodiments along with the appended drawings and claims.

BRIEF DESCRIPTION OF THE DRAWINGS

FIG. 3 is a chart showing the various conditions of the refrigeration system of FIG. 2.

DETAILED DESCRIPTION

Figure 1:
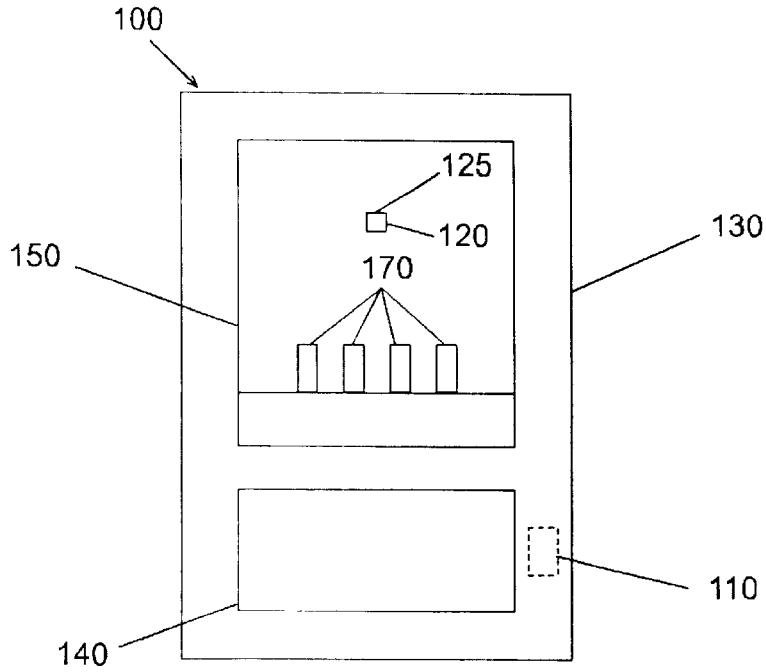
FIG. 1 is a front plan view of a refrigeration device.

With reference to the drawings, in which like numbers indicate like elements throughout the several views, a refrigerated device 100 of the present invention is shown in FIG. 1. The refrigerated device 100 may be a conventional refrigerator, a glass door merchandiser, a vending machine, a cooler, a beverage dispenser, or any type of refrigerated space. The refrigerated device 100 may be controlled by a control system 110. The control system 110 may include a conventional microprocessor. The programming of the control system 110 may be in any conventional programming language. The control system 110 may include one or more temperature sensor 120 so as to determine the temperatures within or adjacent to the refrigerated device 100.

The refrigerated device 100 may have an outer insulated frame 130. The insulated frame 130 may be made out of expanded polystyrene foam, polyurethane foam, or similar types of insulating materials. The insulated frame 130 may include a refrigeration deck area 140 and a refrigerated compartment 150. The refrigeration components, as described in more detail below, may be positioned within the refrigeration deck area 140. The refrigeration deck area 140 and the refrigerated compartment 150 are generally in communication so as to circulate chilled air through the refrigerated compartment 150. One of the temperature sensors 120, a cabinet sensor 125, may be positioned within or in communication with the refrigerated compartment 150. The refrigerated compartment 150 also may have one or more fans 160 or other type of air movement device positioned therein.

A plurality of products 170 may be positioned and cooled within the refrigerated compartment 150. The products 170 may be any type of goods intended to be chilled, such as beverage containers and the like. Although only one row of products 170 is shown, the refrigerated compartment 150 may hold as many products 170 as desired in any configuration. The products 170 also may include one or more fluid streams as may be used in a beverage dispenser.

Figure 2:
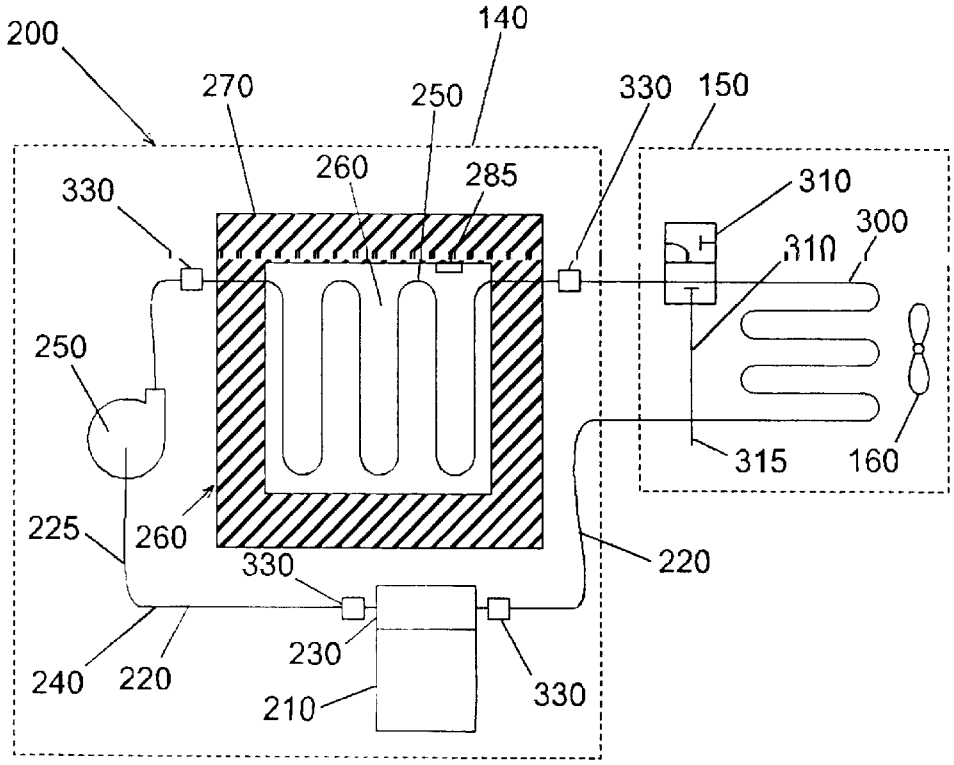
FIG. 2 is a schematic view of a modular eutectic-based refrigeration system of the present invention.

FIG. 2 shows a refrigeration system 200 of the present invention. A portion of the refrigeration system 200 may be positioned within the refrigeration deck area 140 of the refrigerated device 100. The rest of the refrigeration system 200 may be positioned within or adjacent to the refrigerated compartment 150. The refrigeration system 200 may include a modular cold producing unit 210. As is described in more detail below, the cold producing unit 210 may be a Stirling cycle cooler, a Rankine cycle device, a Transcritical Carbon Dioxide cycle device, or similar types of chilling devices.

The cold producing unit 210 may be connected to a heat transfer loop 220 via a heat exchanger 230. In this embodiment, the heat transfer loop 220 may be a secondary liquid refrigerant loop. The heat transfer loop 220 may be made out of a tubing 240. The tubing 240 may be made out of metals such as stainless steel, copper, or aluminum; plastics such as vinyl or nylon; composite materials; or similar types of materials. The heat transfer loop 220 may be insulated. In addition to a secondary liquid refrigeration loop, other types of heat transfer mechanisms may be used such as a primary refrigerant loop, a thermosiphon, a conduction-based system, and similar devices. A thermosiphon-based system is described in commonly owned U.S. patent application Ser. No. 09/813,618, filed on Mar. 21, 2001, and incorporated herein by reference. As used with the heat transfer loop 220, the heat exchanger 230 herein may be a fluid heat exchanger. Depending upon the nature of the cold producing unit 210 and the heat transfer loop 220, however, other types of heat exchangers may be used such as a solid heat exchanger and similar devices.

The heat transfer loop 220 may circulate a heat transfer fluid 225 via a pump 250. The pump 250 may be a conventional centrifugal, positive displacement-type, or a similar type of device. The pump 250 may have a capacity of about 500 to 20000 milliliters per minute. The heat transfer fluid 225 may be water, alcohols such as methanol or propanol, or similar types of fluids with good thermal transfer characteristics.

A modular thermal storage unit 260 also may be positioned in the heat transfer loop 220. The thermal storage unit 260 may include an insulated container 270. The insulated container 270 may be made out of expanded polystyrene, polyurethane foam, or similar types of insulated materials. The container 270 may be filled with a eutectic or eutectic-type material 280. The eutectic material 280 may be a phase change material such as water or an aqueous solution including, for example, salts, alcohols such as glycol, or similar types of materials. The temperature of the eutectic material 280 may be monitored by one of the temperature sensors 120, a eutectic sensor 285, in communication with the control system 110. The heat transfer loop 220 may take the form of a heat exchanger 290 as it passes through the container 270. The heat exchanger 290 preferably is configured to maximize the surface contact area between the heat exchanger 290 and the eutectic material 280. As is shown, the heat exchanger 290 may take a serpentine path or a similar path.

The heat transfer loop 220 may then continue out of the refrigeration deck area 140 and into or adjacent to the refrigerated compartment 150. Positioned within or adjacent to the refrigerated compartment 150 may be a cabinet heat exchanger 300. The cabinet heat exchanger 300 also may be a fluid heat exchanger given the use of the secondary liquid refrigeration loop as the heat transfer loop 220. A solid heat exchanger or other type of heat transfer device also may be used. The cabinet heat exchanger 300 may take the shape of the serpentine path. The cabinet heat exchanger 300 may be positioned within or in thermal communication with the refrigerated compartment 150 so as to chill the space and the products 170 therein. The fan 160 may be positioned adjacent to the cabinet heat exchanger 300.

The cabinet heat exchanger 300 may be connected to the heat transfer loop 220 via a by-pass valve 310. The by-pass valve 310 may be a conventional multi-directional valve, a solenoid valve, or similar types of devices. The by-pass valve 310 thus permits the heat transfer fluid 225 to flow either through the cabinet heat exchanger 300 or through a by-pass line 320. The by-pass line 320 later rejoins the heat transfer loop 220 on the other side of the cabinet heat exchanger 300 at a T-joint 315 or a similar type of structure. The control system 205 may be programmed so as to open or close the by-pass valve 310 depending upon the temperature within the refrigerated compartment 150 as determined with by the sensor 120. The operation of the by-pass valve 310 is described in more detail below. The heat transfer loop 220 may then return to the refrigeration deck area 140 and back to the cold producing unit 210.

Each of the elements of the refrigeration system 200 may be connected to the heat transfer loop 220 via a quick disconnect fitting 330. The quick disconnect fittings 330 allow the individual components to be removed from or added to the refrigeration system 200 in a fast and efficient manner. The use of the quick disconnect fittings 330 also allows the refrigeration system 200 to be expanded or otherwise revised. The quick disconnect fittings 330 may include shut off-type valves that allow the tubing 240 of the heat transfer loop 220 to be disconnected quickly. The fittings 330 may be self-sealing. Other examples of quick disconnect fittings 330 may be provided by CPC Colder Products, Inc. of St. Paul, Minnesota and found at www-.colderproducts.com.

In use, the refrigeration system 200 may rely upon the control system 110 and the temperature sensors 120 to determine the temperature within the thermal storage unit 260 and the refrigerated compartment 150. FIG. 3 shows a control matrix for operation of the by-pass valve 310 and the other components of the refrigeration system 200. As is shown, the control system 110 will direct the by-pass valve to allow the heat transfer fluid 225 to run through the cabinet heat exchanger 300 when the cabinet temperature sensor 125 senses that the refrigerated compartment 150 is too warm as compared to a predetermined set point. The refrigeration system 200 thus may use the combination of the cold producing unit 210 and the thermal storage unit 260 to bring the temperature in the refrigerated compartment 150 to its set point. Likewise, the control system 110 also may direct the by-pass valve 310 to send the heat transfer fluid 225 into the by-pass line 320 so as to by-pass the cabinet heat exchanger 300 if the refrigerated compartment 150 is either at its set point or too cold. The cold producing unit 210 thus may chill the eutectic material 280 within the thermal storage unit 260.

The capacity at which the cold producing unit 210 operates, in this case the Stirling cycle cooler, also may depend upon whether the eutectic material 280 within the thermal storage unit 260 is too warm, too cold, or at its set point as determined by the eutectic temperature sensor 285. The cold producing unit 210 may need to operate at its peak capacity if both the eutectic material 280 within the thermal storage unit 260 and the refrigerated compartment 150 are too warm or even if the refrigerated compartment 150 is at its set point but the thermal storage unit 260 is too warm. Conversely, the cold producing unit 210 may be modulated to very low power or turned off if the thermal storage unit 260 and the refrigerated compartment 150 are too cold or even if the refrigerated compartment 150 is at its set point but the thermal storage unit 260 is too cold.

Because the individual components in the refrigeration system 200 are modular and may be connected and disconnected via the quick disconnect fittings 330, the refrigeration system 100 may be sized for the intended use of the refrigerated device 100 as a whole. The refrigeration capacity of the refrigeration system 200 preferably may be sized to exceed the average total heat load expected within the refrigerated compartment 150 during a typical duty cycle. Selecting the appropriate number and/or size of the cold producing units 210 may modify the total refrigeration capacity of the refrigeration system 200. Each cold producing unit 210 may have a given refrigeration capacity such that the combination of units 210 provides the predetermined capacity or a single cold producing unit 210 with the predetermined refrigeration capacity may be used.

Likewise, the heat storage capacity of the refrigeration system 200 also may be sized to provide the additional refrigeration needed above the refrigeration capacity of the cold producing units 210 during peak periods of demand. Selecting the appropriate number and/or size of the thermal storage units 260 may modify the total heat storage capacity of the refrigeration system 200. Each thermal storage unit 260 may have a given eutectic mass such that the combination of units 260 provides the predetermined capacity or a single thermal storage unit 260 with the predetermined mass may be used.

Figure 4:
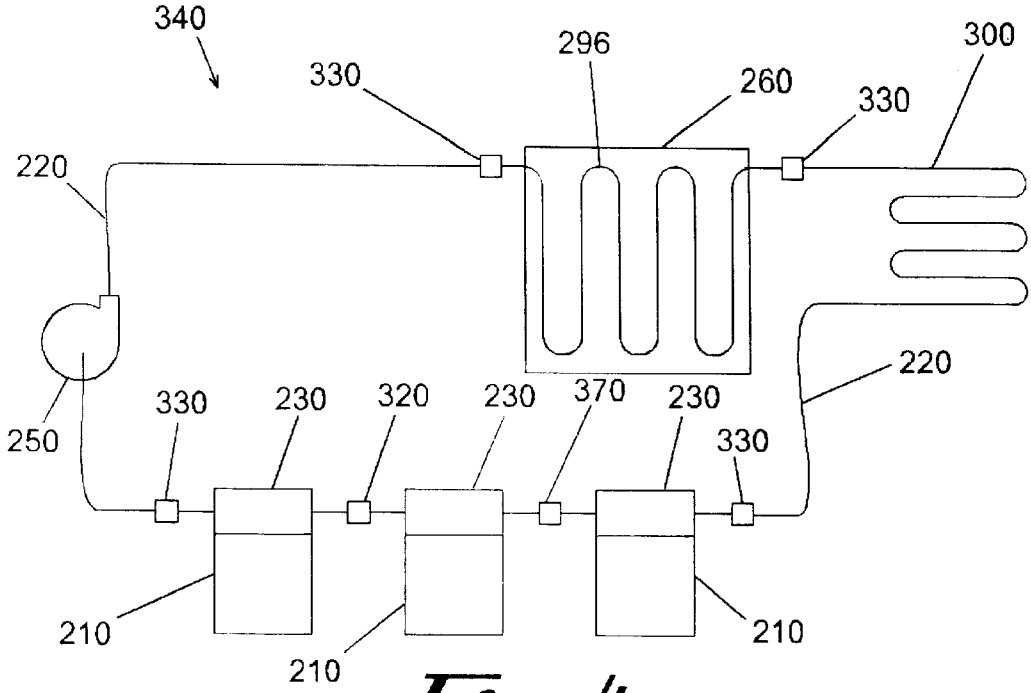
FIG. 4 is a schematic view of a refrigeration system with multiple cold producing units and a single thermal storage unit.

For example, FIG. 4 shows a refrigeration system 340 sized for a large average heat load but low peak demand loads. As such, multiple cold producing units 210 may be used with a single thermal storage unit 260. In this example, the refrigerated compartment 150 may have a refrigerated area of approximately 750 liters. In order to maintain the refrigerated compartment 150 at about zero (0) to four (4) degrees Celsius, three (3) cold producing units 210, in this case Stirling cycle coolers, each may have a capacity of about 680 to 1,020 BTU/hour. Alternatively, a single cold producing unit 210 with a capacity of about 2,040 to 3,060 BTU/hour may be used. Because peak demands loads are expected to be low, the thermal storage unit may have a capacity of about 4,000 to 6,000 BTU. Peak demand loads may occur, for example, when the refrigerated compartment 150 is open to the ambient environment during use or loading or during dispensing operations in a beverage dispenser.

Figure 5:
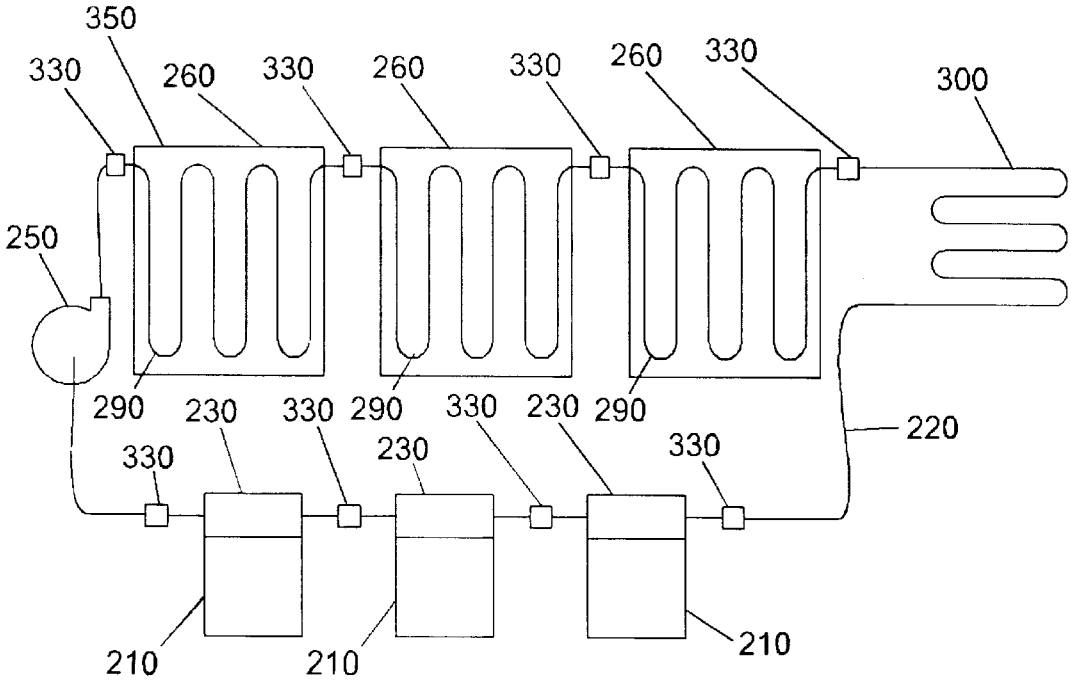
FIG. 5 is a schematic view of a refrigeration system with multiple cold producing units and multiple thermal storage units.
Figure 6:
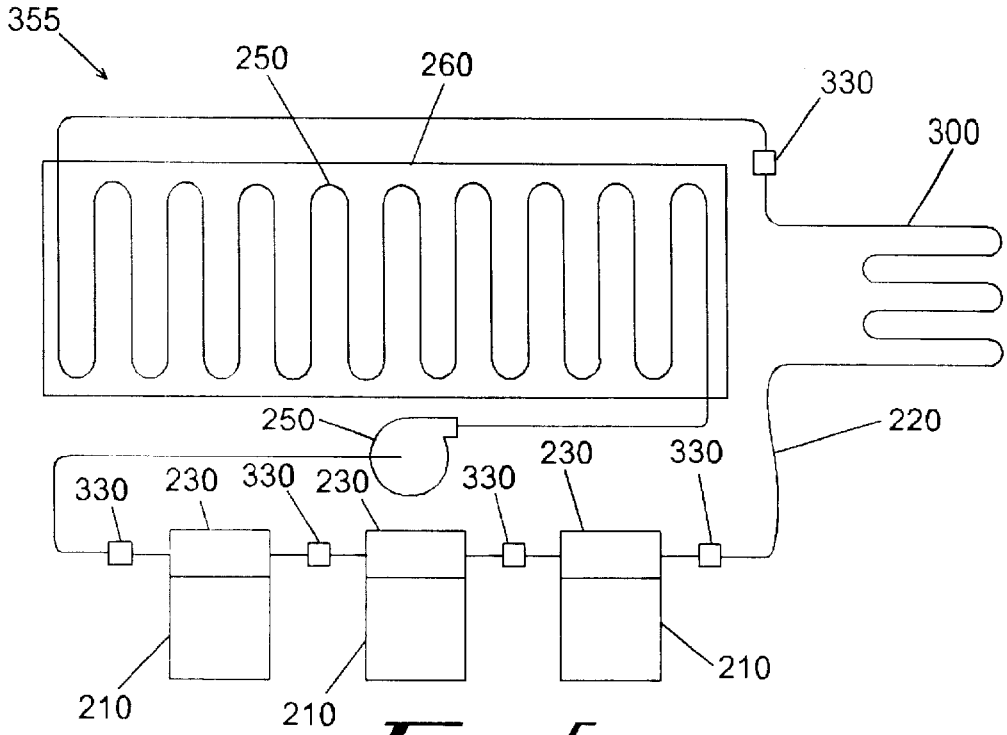
FIG. 6 is a schematic view of a refrigeration system with multiple cold producing units and an expanded thermal storage unit.

FIG. 5 shows a refrigeration system 350 sized for a large average heat load and high peak demand loads. Because the peak demand loads are higher than those expected from the refrigeration system 340 of FIG. 4, the refrigeration system 350 of FIG. 5 may use three (3) thermal storage units with a capacity each of about 4,000 to 6,000 BTU. Alternatively as is shown in FIG. 6, a refrigeration system 355 with a single thermal storage unit 260 having a capacity of about 12,000 to 18,000 BTU may be used. The cold producing units 210 used herein may have the same or a similar capacity to those described above in FIG. 4 for the large average heat loads.

Figure 7:
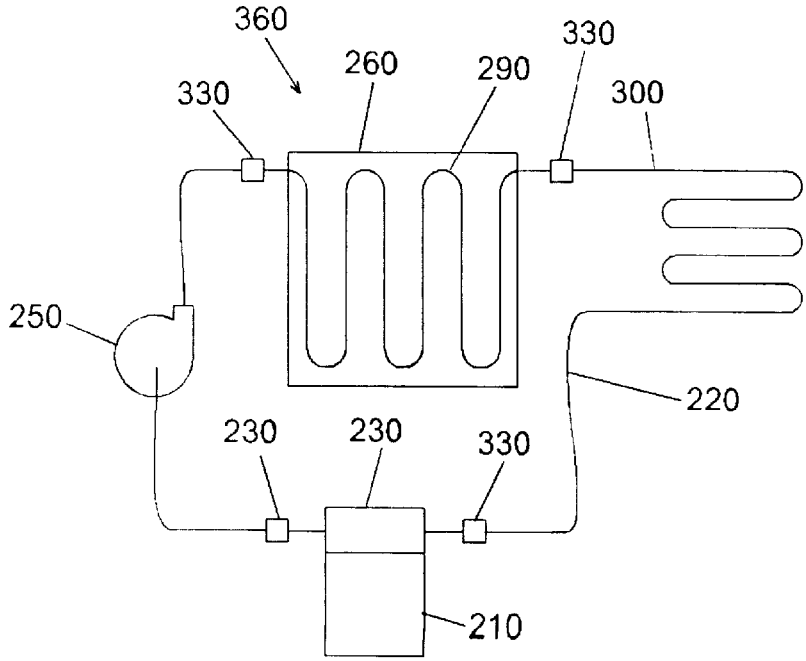
FIG. 7 is a schematic view of a refrigeration system with one cold producing unit and one thermal storage unit.

FIG. 7 shows a refrigeration system 360 designed for a small average heat load and low peak demands loads. A single cold producing unit 210 with a capacity of about 680 to 1,020 BTU/hour and a single thermal storage unit 260 with a capacity of about 4,000 to 6000 BTU may be used.

Figure 8:
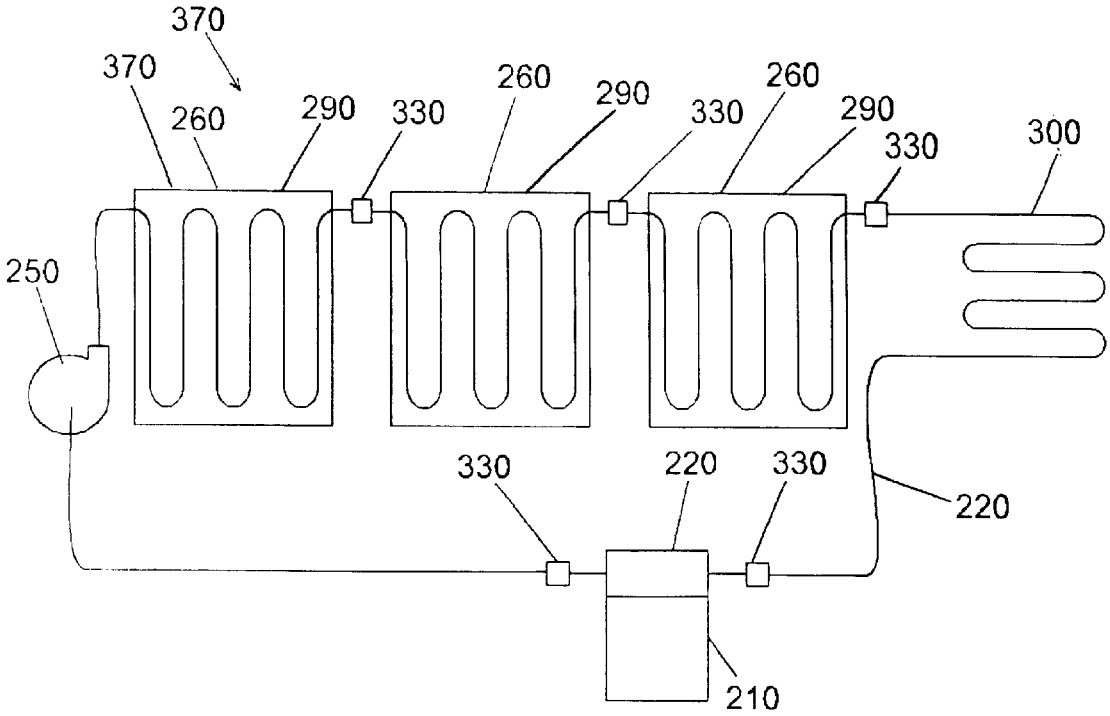
FIG. 8 is a schematic view of a refrigeration system with one cold producing unit and multiple thermal storage units.
Figure 9:
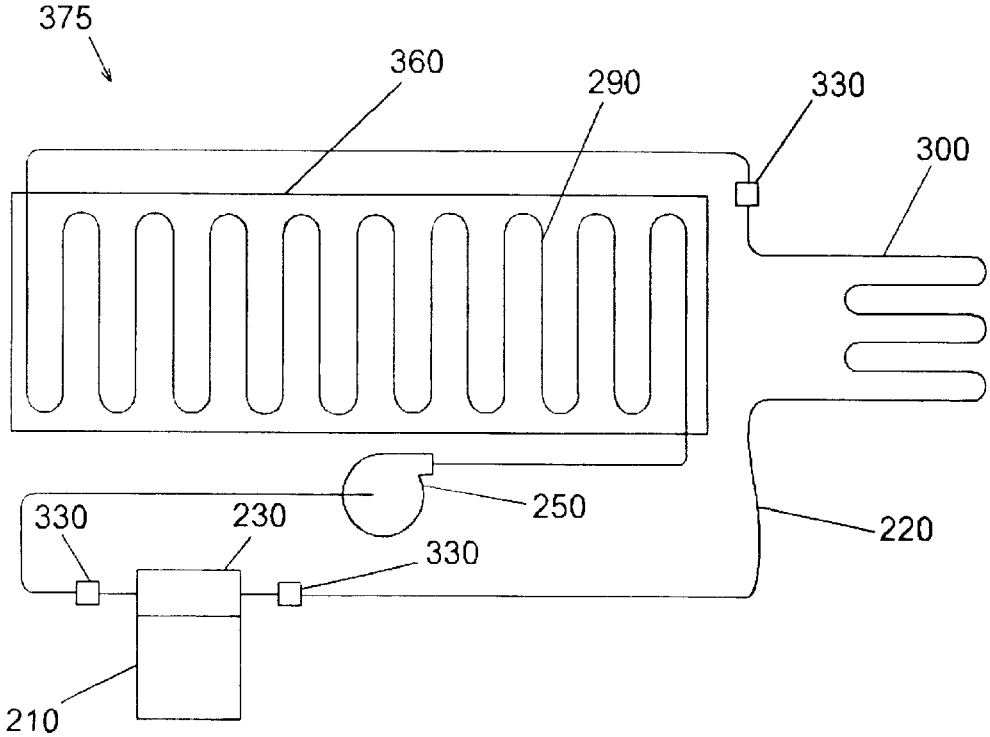
FIG. 9 is a schematic view of a refrigeration system with one cold producing unit and an expanded thermal storage unit.

FIG. 8 shows a refrigeration system 370 sized for a small average heat load and high peak demand loads. In this case, a single cold producing unit 210 with a capacity of about 680 to 1,020 BTU/hour may be used. Three (3) thermal storage units 260, each with a capacity of about 4,000 to 6000 BTU also may be used to accommodate the expected high peak demand loads. Alternatively as is shown in FIG. 9, a refrigeration system 375 with a single thermal storage unit 260 having a capacity of about 12,000 to 18,000 may be used.

As is shown, the cold producing capacity and the thermal storage capacity of the refrigeration system 200 as a whole may be varied by the addition of any number or size of the cold producing units 210 and the thermal storage units 260.

The refrigeration system 200 thus may be modified for any intended use of the refrigeration device 100 as a whole. Further, modification of the refrigeration system 200 is vastly simplified in that the various components may be added or subtracted via the quick disconnects fittings 330. Any number of cold producing units 210 or thermal storage units 260 may be used.

Figure 10:
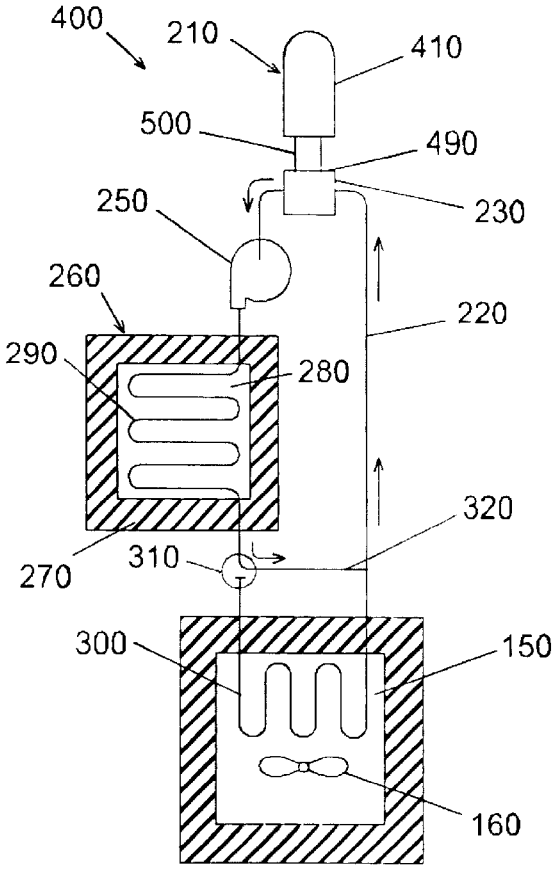
FIG. 10 is a schematic view of a refrigeration system using a Stirling cooler with the heat transfer loop bypassing the refrigerated cabinet.
Figure 11:
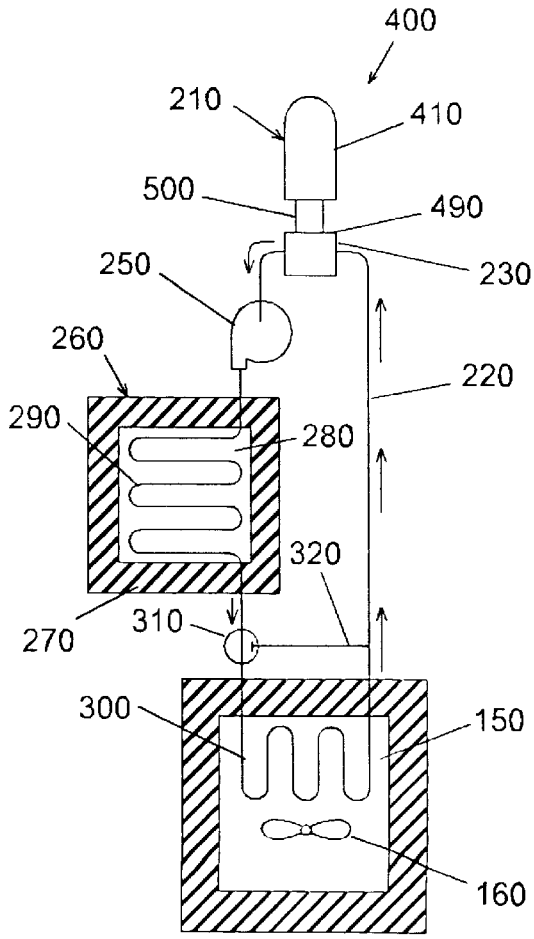
FIG. 11 is a schematic view of a refrigeration system using a Stirling cooler with the heat transfer loop running through the refrigerated cabinet.

FIGS. 10 and 11 show a refrigeration system 400 according to the present invention. In this system, the cold producing unit 210 is a Stirling cycle cooler 410. A particularly useful type of Stirling cooler 410 is a free piston Stirling cooler. A free piston Stirling cooler useful in the present invention is available from Global Cooling of Athens, Ohio. Other Stirling coolers 410 useful in the present invention are shown in U.S. Pat. Nos. 5,678,409; 5,647,217; 5,638,684; 5,596,875; 5,438,848; and 4,922,722, the disclosures of which are incorporated herein by reference. Any conventional type of free piston Stirling cooler, however, may be used herein. As is well known, the Stirling cooler 410 may have a cold portion 490 and a hot portion 500.

The cold portion 490 of the Stirling cooler 410 may be connected to the heat transfer loop 220 via the heat exchanger 230. As is described above, the heat transfer loop 220 runs through the thermal storage unit 260 to the by-pass valve 310. The by-pass valve 310 directs the flow of the heat transfer fluid 225 either back towards the cold producing unit 210 as is shown in FIG. 10 or towards the cabinet heat exchanger 300 as is shown in FIG. 11

Figure 12:
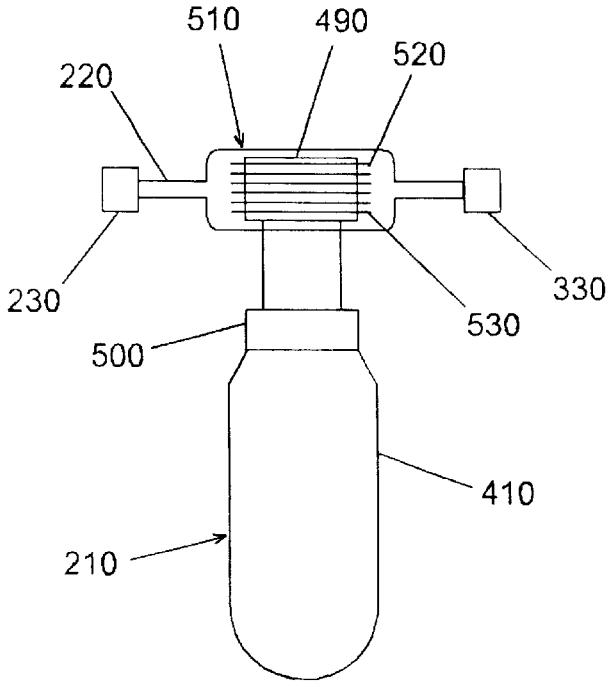
FIG. 12 is a plan view of a Stirling cooler with a heat exchanger.

FIG. 12 shows a heat exchanger 510 intended for use with the Stirling cooler 410. The heat exchanger 510 may have a number of fins 520 attached to the cold portion 490 of the Stirling cooler 410. The fins 520 may be positioned within a plenum 530. The plenum 530 allows the heat transfer fluid 225 within the heat transfer loop 220 to flow through the fins 520 for heat transfer therewith. Heat within the heat transfer fluid 225 is removed by the fins 520 and the cold portion 490 and transferred to the hot portion 500. The heat is then transferred from the hot portion 500 of the Stirling cooler 410 out of the refrigeration system 400 as is well known in the art. As is shown, this cold producing unit 210 and the heat exchanger 510 may be removed and/or added via the quick disconnect fittings 330. Any conventional type of heat exchanger may be used herein.

Figure 13:
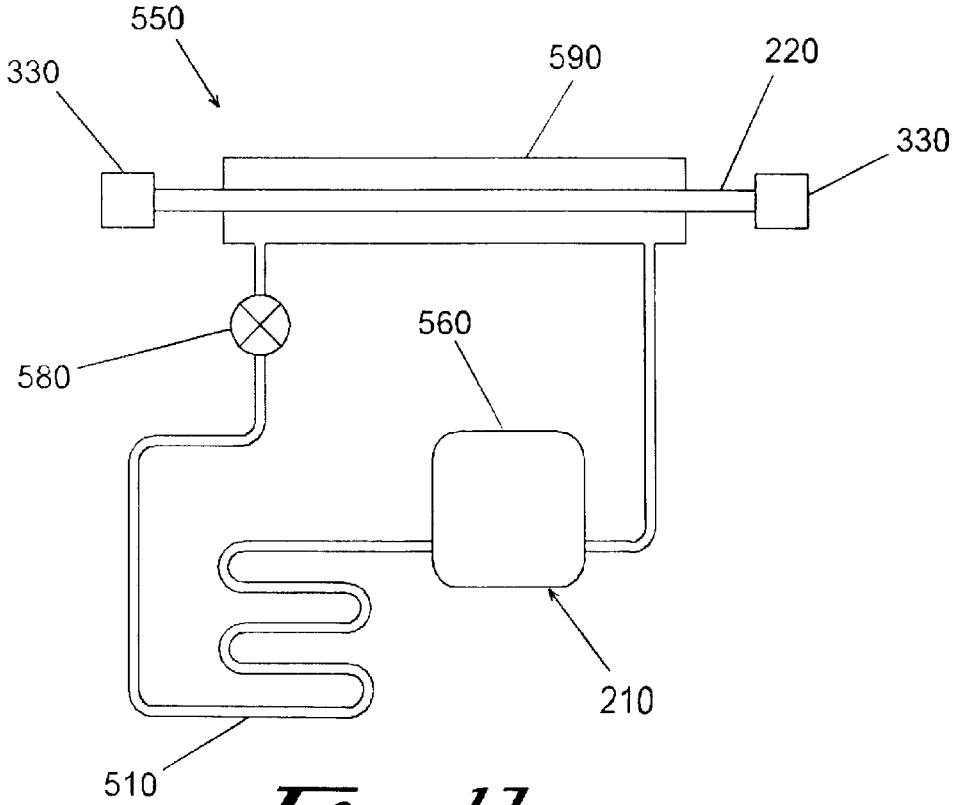
FIG. 13 is a schematic view of a refrigeration system with a Ranking cycle device.

FIG. 13 shows a refrigeration system 550 for use with the present invention. The cold producing unit 210 used herein may be either a Rankine cycle or a Transcritical Carbon Dioxide cycle system. In either case, the cold producing unit 210 may include a compressor 560, a condenser 570, and a flow restricting device 580. The operation of these components is well known in the art and will not be repeated here. These components are used with a heat exchanger 590 as shown therein. The heat exchanger 590 may be a fluid heat exchanger or other type of conventional design. This cold producing unit 210 and the heat exchanger 590 also may be removed and/or added via the quick disconnect fittings 330.

Figure 14:
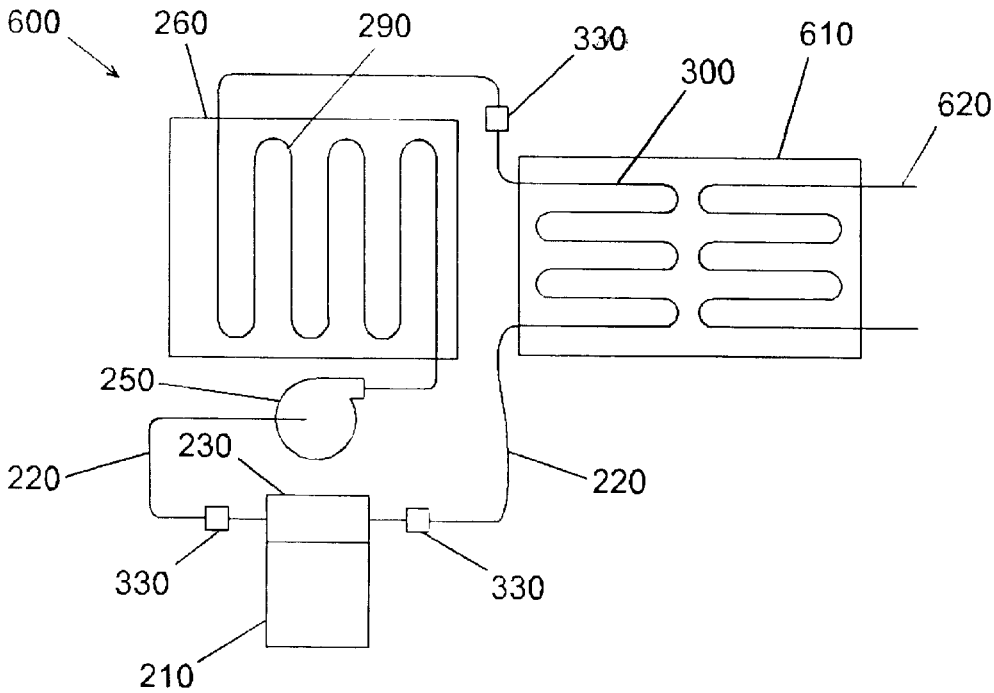
FIG. 14 is a schematic view of a modular eutectic-based fountain dispenser.

FIG. 14 shows an alternative to the refrigerated device 100. In this case, a beverage dispenser 600 is shown. The beverage dispenser 600 may be used with the refrigeration system 200 as described above. In this case, the cabinet heat exchanger 300 is positioned within a block 610 of heat conducting material. The block of heat conducting material 610 may be made out of aluminum or similar types of materials with good heat transfer characteristics. Also positioned within the block 610 may be a product line 620. A beverage to be chilled may run through the product line 620 for heat transfer with the block 610. The temperature of the block 610 may be controlled in a matter similar to that described above with respect to the refrigerated compartment 150. The components herein all may be connected by the quick disconnect fittings 330 as is described above.

Figure 15:
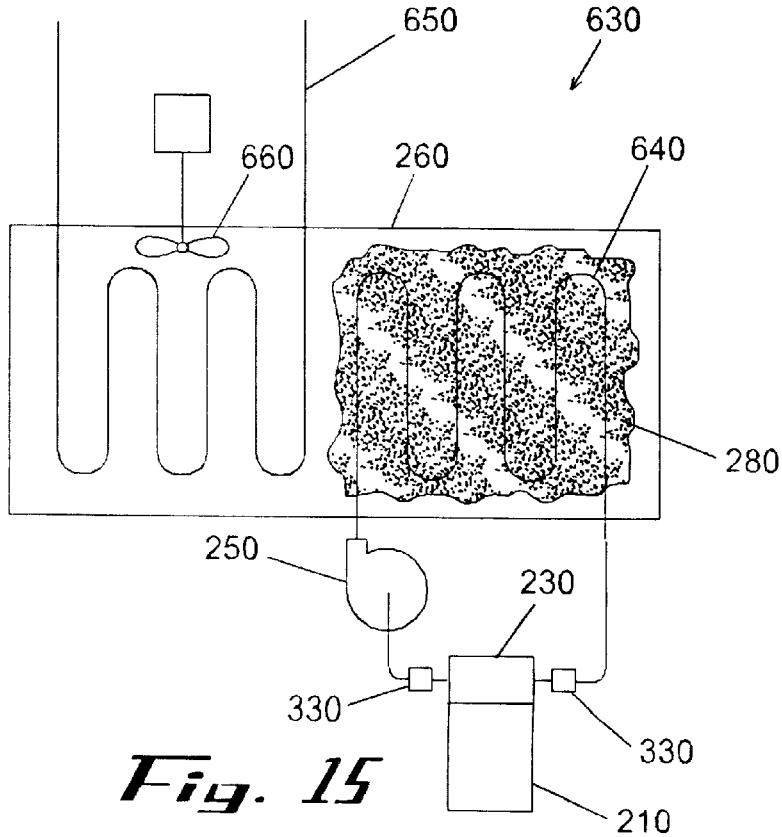
FIG. 15 is a schematic view of a modular eutectic-based fountain dispenser.

FIG. 15 shows a further alternative to the refrigerated device 100, a beverage dispenser 630. In this case, the eutectic material 280 within the thermal storage unit 260 may be water. The beverage dispenser 630 also may have a heat transfer loop 640 that circulates the heat transfer fluid 225 between the thermal storage unit 260 and the cold producing unit 210. The thermal storage unit 260 may be expanded and may include one or more product lines 650. The thermal storage unit 260 also may include an agitator 660 therein to maintain the water adjacent to the product lines 650 in liquid form and control the growth of an ice bank therein. A beverage to be chilled may flow through one of the product lines 650 so as to provide heat transfer with the eutectic material 280.

It should be apparent that the foregoing relates only to the preferred embodiments of the present invention and that numerous changes and modifications may be made herein without departing from the spirit and scope of the invention as defined by the following claims.

We claim:

1. A refrigeration system for chilling an enclosure, comprising:

a thermal transfer pathway;

a cold producing unit connected to said thermal transfer pathway;

a thermal storage unit connected to said thermal transfer pathway; and said cold producing unit and said thermal storage unit connected to said thermal transfer pathway via a plurality of quick disconnect fittings.

2. The refrigeration system of claim 1, wherein said quick disconnect fittings comprise shut off devices.

3. The refrigeration system of claim 1, wherein said cold producing unit comprises one or more modular devices.

4. The refrigeration system of claim 1, wherein said cold producing unit comprises a Stirling cooler.

5. The refrigeration system of claim 1, wherein said cold producing unit comprises a Rankine cycle device.

6. The refrigeration system of claim 1, wherein said thermal transfer pathway comprises a secondary liquid refrigerant loop with a heat transfer liquid therein.

7. The refrigeration system of claim 6, wherein said cold producing unit connects to said thermal transfer pathway via a heat exchanger.

8. The refrigeration system of claim 7, wherein said heat exchanger comprises a fluid heat exchanger.

9. The refrigeration system of claim 6, wherein thermal transfer pathway comprises a pump.

10. The refrigeration system of claim 1, wherein said thermal storage unit comprises one or more modular devices.

11. The refrigeration system of claim 1, wherein said thermal storage unit comprises a eutectic material therein.

12. The refrigeration system of claim 1, wherein said thermal storage unit comprises a heat exchanger positioned therein.

13. The refrigeration system of claim 1, wherein said thermal storage unit comprises a temperature sensor.

14. The refrigeration system of claim 1, further comprising an enclosure heat exchanger connected to said thermal transfer loop, said enclosure heat exchanger positioned for chilling said enclosure.

15. The refrigeration system of claim 14, further comprising a temperature sensor positioned about said enclosure heat exchanger so as to determine the temperature within said enclosure.

16. The refrigeration system of claim 14, wherein said thermal transfer pathway comprises a by-pass valve positioned adjacent to said enclosure heat exchanger so as to by-pass said enclosure heat exchanger if desired.

17. The refrigeration system of claim 16, wherein said thermal transfer pathway comprises a by-pass line connected to said by-pass valve.

18. The refrigeration system of claim 16, wherein said by-pass valve shuts said enclosure heat exchanger when the temperature within said enclosure is at or below a predetermined temperature.

19. The refrigeration system of claim 16, wherein said by-pass valve opens said enclosure heat exchanger when the temperature within said enclosure is above said predetermined temperature.

20. The refrigeration system of claim 14, further comprising a heat transfer block in communication with said enclosure heat exchanger.

21. The refrigeration system of claim 20, wherein said heat transfer block comprises a fluid line therein.

22. The refrigeration system of claim 1, further comprising a control system for operating said thermal transfer pathway and said cold producing unit.

23. The refrigeration system of claim 1, wherein said thermal storage unit comprises a fluid line therein.

24. The refrigeration system of claim 23, wherein said thermal storage unit comprises an agitator therein.

25. A refrigeration system for chilling an enclosure, comprising:

a fluid pathway;

said fluid pathway comprising a heat transfer fluid therein;

one or more Stirling coolers connected to said fluid pathway;

one or more thermal storage units connected to said fluid pathway; and a heat exchanger positioned in communication with said enclosure;

said fluid pathway comprising a by-pass valve such that said heat transfer fluid may pass through or by-pass said heat exchanger.

26. The refrigeration system of claim 25, further comprising a temperature sensor positioned within said enclosure such that said by-pass valve allows said heat transfer fluid to flow though said heat exchanger when the temperature within said enclosure exceeds a predetermined temperature as sensed by said temperature sensor.

27. The refrigeration system of claim 26, further comprising a control system in communication with said by-pass valve and said temperature sensor.

28. The refrigeration system of claim 25, wherein said one or more Stirling coolers and said one or more thermal storage units may connect to said fluid pathway via a plurality of quick disconnect fittings.

29. The refrigeration system of claim 25, wherein said thermal storage unit comprises a eutectic material therein.

30. A beverage dispenser, comprising:

a heat transfer pathway;

said heat transfer pathway comprising a heat transfer fluid therein;

one or more modular cold producing units connected to said heat transfer pathway;

one or more modular thermal storage units connected to said heat transfer pathway;

said heat transfer pathway comprising means to modify in number said one or more modular cold producing units and said one or more modular thermal storage units connected thereto;

a heat exchanger connected to said heat transfer pathway; and a product pathway positioned in thermal communication with said heat exchanger.

31. The beverage dispenser of claim 30, wherein said one or more modular cold producing units comprise one or more Stirling coolers.

32. The beverage dispenser of claim 30, wherein said one or more modular thermal storage units comprise a eutectic material.

33. The beverage dispenser of claim 30, further comprising a heat transfer block in communication with said heat exchanger and said product pathway.

34. The beverage dispenser of claim 30, wherein said heat transfer pathway comprises a plurality of quick disconnect fitting such that said one or more modular cold producing units and said one or modular thermal storage units may connect thereto.

35. A refrigeration system for chilling an enclosure, comprising:

a thermal transfer pathway;

a number of modular cold producing units connected to said thermal transfer pathway;

wherein said number of modular cold producing units connected to said thermal transfer pathway may be modified so as to modify a total cold producing capacity of said refrigeration system;

a number of modular thermal storage units connected to said thermal transfer pathway;

wherein said number of modular thermal storage units connected to said thermal transfer pathway may be modified so as to modify a total thermal storage capacity of said refrigeration system; and a heat exchanger connected to said heat transfer pathway, said heat exchanger positioned so as to chill said enclosure.

36. A method for determining the configuration of a refrigeration system, comprising the steps of:

determining an expected average heat load for said refrigeration system;

installing one or more modular cold producing units with a capacity sufficient to accommodate said expected average heat load;

determining an expected peak demand load for said refrigeration system; and installing one or more modular thermal storage units with a capacity sufficient to accommodate said expected peak demand load.

37. The method of claim 36, further comprising the steps of:

operating said refrigeration system;

determining an average heat load for said refrigeration system; and modifying a number of said one or more modular cold producing units to accommodate said average heat load.

38. The method of claim 37, wherein said step of modifying said number of said one or more modular cold producing units comprises adding or removing one or more of said one or more modular cold producing units.

39. The method of claim 36, further comprising the steps of:

operating said refrigeration system;

determining a peak demand load for said refrigeration system; and modifying a number of said one or more modular thermal storage units to accommodate said peak demand load.

40. The method of claim 39, wherein said step of modifying said number of said one or more modular thermal storage units comprises adding or removing one or more of said one or more modular thermal storage units.

41. The method of claim 36, further comprising the steps of:

revising said expected average heat load for said refrigeration system; and modifying a number of said one or more modular cold producing units to accommodate said expected average heat load.

42. The method of claim 36, further comprising the steps of:

modifying said expected peak demand load for said refrigeration system; and modifying a number of said one or more modular thermal storage units to accommodate said expected peak demand load.

43. The method of claim 36, wherein said one or more modular cold producing units comprise Stirling cooler units.

44. The method of claim 36, wherein said one or more modular thermal storage units comprise a eutectic material.

45. A system for heat transfer within an enclosure, said system comprising:

a fluid pathway;

said fluid pathway comprising a heat transfer fluid therein;

a Stirling cycle device connected to said fluid pathway;

one or more thermal storage units connected to said fluid pathway;

a heat exchanger in thermal communication with said thermal storage unit; and said fluid pathway comprising a by-pass valve such that said heat transfer fluid may pass through or by-pass said thermal storage unit.

* * * * *

UNITED STATES PATENT AND TRADEMARK OFFICE

CERTIFICATE OF CORRECTION

PATENT NO. : 6,481,216 B2
DATED : November 19, 2002
INVENTOR(S) : Simmons et al.

It is certified that error appears in the above-identified patent and that said Letters Patent is hereby corrected as shown below:

Title page,
Item [56], U.S. PATENT DOCUMENTS, please insert:

| | | |
|---|---|---|
| 2,095,008 | 10/05/37 | Philipp .....6 2/115 |
| 2,342,299 | 02/22/44 | Peet .....2 25/40 |
| 2,512,545 | 06/20/50 | Hazard .....6 2/125 |
| 2,961,082 | 11/22/60 | Hanson *et al.*.....1 94/13 |
| 3,302,429 | 02/07/67 | Byrd .....6 2/514 |
| 4,843,826 | 07/04/89 | Malaker.....6 2/6 |
| 5,094,083 | 03/10/92 | Horn *et al.*.....6 2/6 |
| 5,735,131 | 04/07/98 | Lambright, Jr., *et al.* ..6 2/99 |
| 5,878,581 | 03/09/99 | DeFrances *et al.* .....6 2/50.2 |
| 6,112,526 | 09/05/00 | Chase .....6 2/6 |
| 1,815,170 | 07/21/31 | Summers |
| 2,470,547 | 05/17/49 | Childers .....6 2/103 |
| 2,660,037 | 11/24/53 | Cooper .....6 2/116 |
| 2,672,029 | 03/16/54 | Saunders .....6 2/117.2 |
| 2,885,142 | 05/05/59 | Eberhart .....2 30/117 |
| 3,004,408 | 10/17/61 | Dros *et al.* .....6 2/419 |
| 3,206,943 | 09/21/65 | Rice *et al.* |
| 3,230,733 | 01/25/66 | Rutishauser, *et al.* .....6 2/256 |
| 3,712,078 | 01/23/73 | Maynard *et al.*.....6 2/448 |
| 3,853,437 | 12/10/74 | Horn *et al.*.....4 18/61 |
| 3,997,028 | 12/14/76 | Lopez.....1 86/1 |
| 4,037,081 | 07/19/77 | Aldridge *et al.*.....2 19/387 |
| 4,037,650 | 07/26/77 | Randall .....1 65/29 |
| 4,138,855 | 02/13/79 | Jahan *et al.*.....6 2/112 |
| 4,176,526 | 12/04/79 | Missimer.....6 2/278 |
| 4,176,529 | 12/04/79 | Stierlin *et al.*.....6 2/490 |
| 4,259,844 | 04/07/81 | Sarcia *et al.* .....6 2/6 |
| 4,275,705 | 06/30/81 | Schaus *et al.*.....1 26/110 R |
| 4,306,613 | 12/22/81 | Christopher.....6 5/32 |
| 4,377,074 | 03/22/83 | Jardine .....6 2/183 |
| 4,383,421 | 05/17/83 | Quesnoit .....6 2/333 |
| 4,416,122 | 11/22/83 | Johnson.....6 2/448 |
| 4,471,633 | 09/18/84 | Tinsler.....6 2/295 |
| 4,480,445 | 11/06/84 | Goldstein .....6 2/434 |
| 4,490,991 | 01/01/85 | Griffin.....6 2/279 |
| 4,539,737 | 09/10/85 | Kerpers *et al.* .....2 9/423 |
| 4,554,797 | 11/2/85 | Goldstein .....6 2/434 |
| 4,558,570 | 12/17/85 | Shtrikman *et al.* .....6 2/6 |
| 4,694,650 | 09/22/87 | Vincent .....6 0/520 |
| 4,726,193 | 02/23/88 | Burke *et al.* .....6 2/3 |
| 4,759,190 | 07/26/88 | Trachtenberg *et al.*.....6 2/3 |
| 4,783,968 | 11/15/88 | Higham *et al.* .....6 2/6 |
| 4,811,563 | 03/14/89 | Furuishi *et al.*.....6 0/517 |
| 4,823,555 | 04/25/89 | Trachtenberg *et al.*.....6 2/3 |
| 4,827,733 | 05/09/89 | Dinh.....6 2/305 |
| 4,827,735 | 05/09/89 | Foley.....6 2/430 |
| 4,831,831 | 05/23/89 | Carter *et al.* .....6 2/59 |
| 4,852,362 | 08/01/89 | Conry.....62/175 |
| 4,882,911 | 11/28/89 | Immel.....6 2/288 |
| 4,893,478 | 01/16/90 | Kruck *et al*.....62/126 |
| 4,907,419 | 03/13/90 | Kruck *et al*.....62/263 |
| 4,917,256 | 04/17/90 | Kruck *et al*.....220/4 F |
| 4,922,722 | 05/08/90 | Kazumoto *et al.* .....6 2/6 |
| 4,941,527 | 07/17.90 | Toth *et al.* .....1 65/47 |
| 4,949,554 | 08/21/90 | Banz *et al.*.....6 2/248 |
| 4,964,279 | 10/23/90 | Osborne .....6 2/59 |
| 4,977,754 | 12/18/90 | Upton *et al.* .....6 2/248 |
| 4,996,841 | 03/05/91 | Meijer *et al.* .....6 0/525 |
| 5,007,246 | 04/16/91 | Kruck *et al*.....62/131 |
| 5,009,081 | 04/23/91 | Kruck *et al*.....62/264 |

UNITED STATES PATENT AND TRADEMARK OFFICE

CERTIFICATE OF CORRECTION

PATENT NO. : 6,481,216 B2
DATED : November 19, 2002
INVENTOR(S) : Simmons et al.

It is certified that error appears in the above-identified patent and that said Letters Patent is hereby corrected as shown below:

U.S. PATENT DOCUMENTS, cont'd,

| | | |
|---|---|---|
| 5,069,273 | 12/03/91 | O'Hearne .....6 5/12 |
| 5,076,351 | 12/31/91 | Munekawa *et al.* .....1 65/104.21 |
| 5,142,872 | 09/01/92 | Tipton .....6 2/6 |
| 5,172,567 | 12/22/92 | Sadhir.....62/434 |
| 5,228,299 | 07/20/93 | Harrington *et al.* .....6 2/55.5 |
| 5,259,198 | 11/09/93 | Viegas *et al.* .....6 2/7 |
| 5,259,214 | 11/09/93 | Nagatomo *et al.* .....6 2/324.1 |
| 5,284,022 | 02/08/94 | Chung .....6 2/6 |
| 5,303,769 | 04/19/94 | Hoegberg .....1 65/108 |
| 5,305,825 | 04/26/94 | Roehrich *et al.* .....1 65/64 |
| 5,309,986 | 05/10/94 | Itoh.....1 65/104.26 |
| 5,311,927 | 05/17/94 | Taylor *et al.* .....1 65/64 |
| 5,333,460 | 08/02/94 | Lewis *et al.* .....6 2/6 |
| 5,341,653 | 08/30/94 | Tippmann *et al.* .....6 2/288 |
| 5,347,827 | 09/20/94 | Rudick *et al.* .....6 2/440 |
| 5,363,671 | 11/15/94 | Forsythe *et al*.....62/197 |
| 5,402,654 | 04/04/95 | Rudick *et al.* .....6 2/448 |
| 5,406,805 | 04/18/95 | Radermacher *et al.*.....6 2/81 |
| 5,417,079 | 05/23/95 | Rudick et al.....6 2/253 |
| 5,417,081 | 05/23/95 | Rudick *et al.* .....6 2/440 |
| 5,438,848 | 08/08/95 | Kim *et al.* .....6 2/342 |
| 5,440,894 | 08/15/95 | Schaeffer *et al.*.....6 2/203 |
| 5,493,874 | 02/27/96 | Landgrebe.....6 2/457.2 |
| 5,496,153 | 03/05/96 | Redlich .....4 17/212 |
| 5,524,453 | 06/11/96 | James .....6 2/434 |
| 5,525,845 | 06/11/96 | Beale *et al.* .....3 10/30 |
| 5,537,820 | 07/23/96 | Beale *et al.* .....6 0/517 |
| 5,542,257 | 08/06/96 | Mattern-Klosson *et al.*62/55.5 |
| 5,551,250 | 09/03/96 | Yingst *et al.* .....6 2/234 |
| 5,596,875 | 01/28/97 | Berry *et al.* .....6 2/6 |
| 5,638,684 | 06/17/97 | Siegel *et al.* .....6 2/6 |
| 5,642,622 | 07/01/97 | Berchowitz *et al.*.....6 2/6 |
| 5,645,407 | 07/08/97 | Kralick *et al.* .....4 17/383 |
| 5,647,217 | 07/15/97 | Penswick *et al.*.....6 2/6 |
| 5,647,225 | 07/15/97 | Fischer *et al.* .....6 2/434 |
| 5,649,431 | 07/22/97 | Schroeder, Jr.....6 2/434 |
| 5,655,376 | 08/12/97 | Price.....6 2/6 |
| 5,678,409 | 10/21/97 | Price.....6 2/6 |
| 5,678,421 | 10/21/97 | Maynard *et al.*.....6 2/407 |
| 5,724,833 | 03/10/98 | Devers.....6 2/625 |
| 5,743,098 | 04/28/98 | Behr.....62/80 |
| 5,743,102 | 04/28/98 | Thomas *et al*.....62/185 |
| 5,782,106 | 07/21/98 | Park.....6 2/452 |
| 5,794,444 | 08/18/98 | Hofbauer *et al.* .....6 0/517 |
| 5,881,566 | 03/16/99 | Shacklock *et al.* .....6 2/277 |
| 5,895,033 | 04/20/99 | Ross *et al.*. .....2 67/161 |
| 5,906,290 | 05/25/99 | Haberkorn.....2 20/505 |
| 5,920,133 | 07/06.99 | Penswick *et al.*.....3 10/17 |
| 5,927,079 | 07/27/99 | Sekiya *et al.* .....6 2/6 |
| 5,927,080 | 07/27/99 | Lee .....6 2/6 |
| 6,003,319 | 12/21/99 | Gilley *et al.* .....6 /23.7 |
| 6,023,937 | 02/15/00 | Rodrigues.....6 2/295 |
| 6,067,804 | 05/30/00 | Moeykens *et al.* .....6 2/84 |
| 6,073,547 | 06/13/00 | Westbrooks, Jr., *et al.* 99/468 |
| 6,079,481 | 06/27/00 | Lowenstein *et al.* .....1 6/510 |
| 6,148,634 | 11/21/00 | Sherwood.....6 2/434 |
| 6,158,499 | 12/12/00 | Rhodes.....1 6/510 |
| 6,178,770 | 01/30/01 | Bradley, Jr., *et al.*.....6 2/434 |

UNITED STATES PATENT AND TRADEMARK OFFICE

CERTIFICATE OF CORRECTION

PATENT NO. : 6,481,216 B2
DATED : November 19, 2002
INVENTOR(S) : Simmons et al.

It is certified that error appears in the above-identified patent and that said Letters Patent is hereby corrected as shown below:

FOREIGN PATENT DOCUMENTS, insert:

| | | |
|---|---|---|
| 2-217758 | 08/30/90 | Japan |
| 64-36468 | 02/07/89 | Japan |
| 7-180921 | 07/18/95 | Japan Toshiba Corp. |
| EP 0 935 063 A2 | 08/11/99 | Japan Sanyo Electric Co., Ltd. |
| JP 01 269874 | 27/10/89 | Japan Mitsubishi Electric Corp. - Abstract Only |
| EP 0 065 995 | 08/12/82 | Europe Fuji Electric Co., Ltd. |
| CH 233 266 | 15/07/44 | Germany Hermes Patentverwertungs |
| 233-266 | 07/15/44 | Patentverwertungs Ges Mit Besc |
| 2-609-789 | 07/22/88 | France Robert Cappa and Michel Vilais Gautrois |
| WO 98/34076 | 08/06/98 | Japan GAC Corporation |
| EP 0 697 089 | 08/12/99 | Hussmann Corporation |
| EP 0 936 421 | 18/08/99 | Hussmann Corporation |
| WO 86/00977 | 13/02/86 | Conry, Ronald, David |
| WO 89/06774 | 27/07/89 | Conry, Ronald, David |
| WO 94/25811 | 10/11/94 | Hussmann Corporation |
| WO 95/02795 | 26/01/95 | Multiplex Company, Inc. |
| WO 96/29555 | 26/09/96 | Hussmann Corporation |
| WO 97/39296 | 23/10/97 | Hussmann Corporation |
| WO 99/23425 | 14/05/99 | Hussmann Corporation |
| WO 99/58914 | 18/11/99 | Victory Refrigeration Co., LLC |

UNITED STATES PATENT AND TRADEMARK OFFICE

CERTIFICATE OF CORRECTION

PATENT NO. : 6,481,216 B2
DATED : November 19, 2002
INVENTOR(S) : Simmons et al.

It is certified that error appears in the above-identified patent and that said Letters Patent is hereby corrected as shown below:

OTHER PUBLICATIONS, insert:

Lyn Bowman, "A Technical Introduction to Free-Piston Stirling Cycle Machines: Engines, Coolers, and Heat Pumps," May, 1993, pp.1-7.
B.D. Mennink *et al.*, "Development of an Improved Stirling Cooler for Vacuum Super Insulated Fridges WithThermal Store and Photovoltaic Power Source for Industrialized and Developing Countries," May 10-13, 1994 pp. 1-9.
D.M. Berchowitz *et al.*, "Recent Advances in Stirling Cycle Refrigeration," August 20-25, 1995, 8 pages.
Kelly McDonald *et al.*, "Stirling Refrigerator for Space Shuttle Experiments," August 7/11, 1994, 6 pages.
Sunpower, Inc., "Introduction to Sunpower, Stirling Machines and Free-Piston Technology," December, 1995.
D.M. Berchowitz *et al.*, "Test Results for Stirling Cycle Cooled Domestic Refrigerators," September 3-6, 1996, 9 pages.
Royal Vendors, Inc., "G-III All Purpose Vendor Operation and Service Manual," September, 1996, pp. 1-67.
D.M. Berchowitz *et al.*, "Stirling Coolers for Solar Refrigerators," 10 pages.
Michael K. Ewert *et al.*, "Experimental Evaluation of a Solar PV Refrigerator with Thermoelectric, Stirling and Vapor Compression Heat Pumps," 7 pages.
D.M. Berchowitz, Ph.D., "Maximized Performance of Stirling Cycle Refrigerators," 8 pages.
David Bergeron, "Heat Pump Technology Recommendation for a Terrestrial Battery-Free Solar Refrigerator," September, 1998, pp. 1-25.
Seon-Young Kim, *et al.*, "The Application of Stirling Cooler to Refrigeration," pp. 1023-1026.
R. H. Green, *et al.*, "The Design and Testing of a Stirling Cycle Domestic Freezer," pp. 153-161.

UNITED STATES PATENT AND TRADEMARK OFFICE

CERTIFICATE OF CORRECTION

PATENT NO. : 6,481,216 B2
DATED : November 19, 2002
INVENTOR(S) : Simmons et al.

It is certified that error appears in the above-identified patent and that said Letters Patent is hereby corrected as shown below:

OTHER PUBLICATIONS cont'd,

Abstract of Japanese Publication No. 02302563 (Toshiba Corp.) 12/14/90.
Abstract of Japanese Publication No. 03036468 (Toshiba Corp.) 02/18/91.
Abstract of Japanese Publication No. 03294753 (Toshiba Corp.) 12/25/91.
Abstract of Japanese Publication No. 04217758 (Toshiba Corp.) 08/07/92.
Abstract of Japanese Publication No. 05203273 (Toshiba Corp.) 08/10/93.
Abstract of Japanese Publication No. 05306846 (Toshiba Corp.) 11/19/93.
Abstract of Japanese Publication No. 07180921 (Toshiba Corp.) 07/18/95.
Abstract of Japanese Publication No. 08005179 (Toshiba Corp.) 01/12/96.
Abstract of Japanese Publication No. 08100958 (Toshiba Corp.) 04/16/96.
Abstract of Japanese Publication No. 08247563 (Toshiba Corp.) 09/27/96.

Signed and Sealed this

Sixth Day of May, 2003

JAMES E. ROGAN
*Director of the United States Patent and Trademark Office*